US009354579B2

(12) United States Patent
Takane

(10) Patent No.: US 9,354,579 B2
(45) Date of Patent: May 31, 2016

(54) IMAGE FORMING APPARATUS FOR FORMING OUTPUT SHEET BUNDLES INSERTED WITH TABBED SHEETS, AND CONTROL METHOD AND STORAGE MEDIUM THEREFOR

(71) Applicant: CANON KABUSHIKI KAISHA, Tokyo (JP)

(72) Inventor: Kunio Takane, Urayasu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 177 days.

(21) Appl. No.: 13/943,835

(22) Filed: Jul. 17, 2013

(65) Prior Publication Data

US 2014/0023415 A1 Jan. 23, 2014

(30) Foreign Application Priority Data

Jul. 18, 2012 (JP) ..... 2012-159602

(51) Int. Cl.

*G03G 15/00* (2006.01)
*B65H 3/44* (2006.01)
*G03G 15/23* (2006.01)

(52) U.S. Cl.

CPC ..... *G03G 15/6529* (2013.01); *G03G 15/6591* (2013.01); *B65H 3/44* (2013.01); *G03G 15/231* (2013.01); *G03G 15/6538* (2013.01); *G03G 2215/00523* (2013.01); *G03G 2215/00586* (2013.01)

(58) Field of Classification Search

CPC ..... G03G 2215/00523; G03G 2215/00586; G03G 15/6538; B65H 2701/11132; B65H 3/44; B65H 15/00; B65H 85/00

See application file for complete search history.

(56) References Cited

U.S. PATENT DOCUMENTS

| | | | | |
|---|---|---|---|---|
| 6,393,232 | B1 * | 5/2002 | Osari et al. | 399/82 |
| 6,539,198 | B2 * | 3/2003 | Miyajima | 399/389 |
| 2012/0003023 | A1 * | 1/2012 | Igarashi | 399/382 |
| 2012/0062943 | A1 * | 3/2012 | Maeda | 358/1.15 |

FOREIGN PATENT DOCUMENTS

JP 2002-003063 A 1/2002

* cited by examiner

*Primary Examiner* — Laura Martin
*Assistant Examiner* — John M Royston
(74) *Attorney, Agent, or Firm* — Rossi, Kimms & McDowell LLP

(57) ABSTRACT

An image forming apparatus capable of suppressing the productivity of image formation from being lowered due to discharge of surplus tabbed sheets in a double-sided printing job in which output sheet bundles are produced by inserting tabbed sheets into each bundle of double-sided printed recording sheets. In a case that output sheet bundles are each produced by setting tabbed sheet bundles each comprised of five tabbed sheets to the image forming apparatus, by inserting one tabbed sheet subsequently to double-sided image formation on five recording sheets, and by performing double-sided image formation on other five recording sheets, four surplus tabbed sheets are discharged subsequently to feeding of the tabbed sheet, instead of discharging the four surplus tabbed sheets after completion of image formation on a second surface of a tenth recording sheet.

9 Claims, 13 Drawing Sheets

IMAGE FORMING APPARATUS FOR FORMING OUTPUT SHEET BUNDLES INSERTED WITH TABBED SHEETS, AND CONTROL METHOD AND STORAGE MEDIUM THEREFOR

BACKGROUND OF THE INVENTION

1. Field of the Invention

The present invention relates to an image forming apparatus such as a copying machine or a printer for forming output sheet bundles each inserted with one or more tabbed sheets, and relates to a control method for the image forming apparatus and a storage medium storing a program for executing the control method.

2. Description of the Related Art

Conventionally, there has been proposed an image forming apparatus having a tabbed sheet mode for creating output sheet bundles in each of which one or more tabbed sheets are inserted at positions corresponding to designated pages for the purpose of adding headings or dividing into chapters.

In the tabbed sheet mode, tabbed sheet bundles each comprised of a plurality of tabbed sheets which are different in tab position from one another are generally used. In an example of FIG. 14, a tabbed sheet bundle is comprised of five tabbed sheets. When output sheet bundles each inserted with three tabbed sheets are produced by using tabbed sheet bundles each comprised of five tabbed sheets, two surplus tabbed sheets are produced in each bundle. To deal with this matter, a user is required to set tabbed sheet bundles, from which surplus tabbed sheets have been removed in advance, to an image forming apparatus. However, this is laborious.

Accordingly, image forming apparatuses have been proposed that are configured to automatically discharge surplus tabbed sheets to the outside each time an output sheet bundle is produced. For example, there is an image forming apparatus configured to discharge output sheet bundles and surplus tabbed sheets to different discharge trays (see, Japanese Laid-open Patent Publication No. 2002-3063).

However, with the image forming apparatus that discharges surplus tabbed sheets after creation of each output sheet bundle, it is necessary to start image formation for the next output sheet bundle after waiting for discharge of the surplus tabbed sheets. In particular, in the case of a double-sided printing job in which tabbed sheets are inserted into between double-sided printed recording sheets to produce a plurality of output sheet bundles, it is necessary, after a last recording sheet used for creation of each output sheet bundle is double-sided printed and discharged to the outside of the apparatus, that a conveyance mode must be changed, surplus tabbed sheets must be discharged, and image formation on recording sheets used for creation of the next output sheet bundle must be started. As a result, the productivity in creating output sheet bundles is lowered.

A double-sided printing job is primarily performed in such away that a sheet interval does not become excessively large at a break between output sheet bundles. For example, double-sided circulation control is made in which a top sheet used for creation of output sheet bundle is started to be fed, without waiting for completion of double-sided printing on a last sheet used for creation of preceding output sheet bundle. As a result, a sheet interval does not become excessively large at a break between output sheet bundles even during the double-sided printing job, whereby high productivity can be maintained.

However, if surplus tabbed sheets are discharged after creation of each output sheet bundle as in the aforementioned conventional image forming apparatus, it is necessary to discharge surplus tabbed sheets after waiting for completion of double-sided printing and discharge of the last sheet used for creation of output sheet bundle. As a result, double-sided circulation control is disconnected at a break between output sheet bundles, and therefore the productivity of image formation is lowered.

SUMMARY OF THE INVENTION

The present invention provides an image forming apparatus capable of suppressing the productivity of image formation from being lowered due to discharge of surplus tabbed sheets in a double-sided printing job in which output sheet bundles are produced by inserting tabbed sheets into each bundle of double-sided printed recording sheets, and provides a control method for the image forming apparatus and a storage medium storing a program for executing the control method.

According to one aspect of this invention, there is provided an image forming apparatus comprising a first supply unit configured to supply at least one tabbed sheet one by one from each of a plurality of tabbed sheet bundles each comprised of tabbed sheets which are different in tab position from one another, a second supply unit configured to supply recording sheets, a conveyance unit configured to convey the tabbed sheet supplied by the first supply unit and the recording sheets supplied by the second supply unit and to discharge them to outside, an image forming unit configured to form images on both surfaces of each of the recording sheets conveyed by the conveyance unit, and a control unit configured, in a case where at least one surplus tabbed sheet not inserted into a corresponding one of at least one output sheet bundle is occurred in each of the tabbed sheet bundles when the at least one output sheet bundle is produced in each of which the at least one tabbed sheet is inserted into a recording sheet bundle comprised of recording sheets each formed with images on its both surfaces by a double-sided image forming operation of the image forming unit, to control the first supply unit and the conveyance unit such that the surplus tabbed sheet is conveyed subsequently to conveyance of the tabbed sheet to be lastly inserted into a corresponding one of the at least one output sheet bundle.

With this invention, surplus tabbed sheets are discharged subsequently to the conveyance of the last tabbed sheet constituting an output sheet bundle, whereby it becomes possible to suppress the productivity of image formation from being lowered due to discharge of surplus tabbed sheets in a double-sided printing job to produce output sheet bundles by inserting tabbed sheets into each bundle of double-sided printed recording sheets.

Further features of the present invention will become apparent from the following description of an exemplary embodiment with reference to the attached drawings.

BRIEF DESCRIPTION OF THE DRAWINGS

FIG. 8B is view showing the order of recording sheet feeding/refeeding in the case of double-sided image formation where the number of circulating sheets is five;

DESCRIPTION OF THE EMBODIMENTS

The present invention will now be described in detail below with reference to the drawings showing a preferred embodiment thereof.

Figure 1:
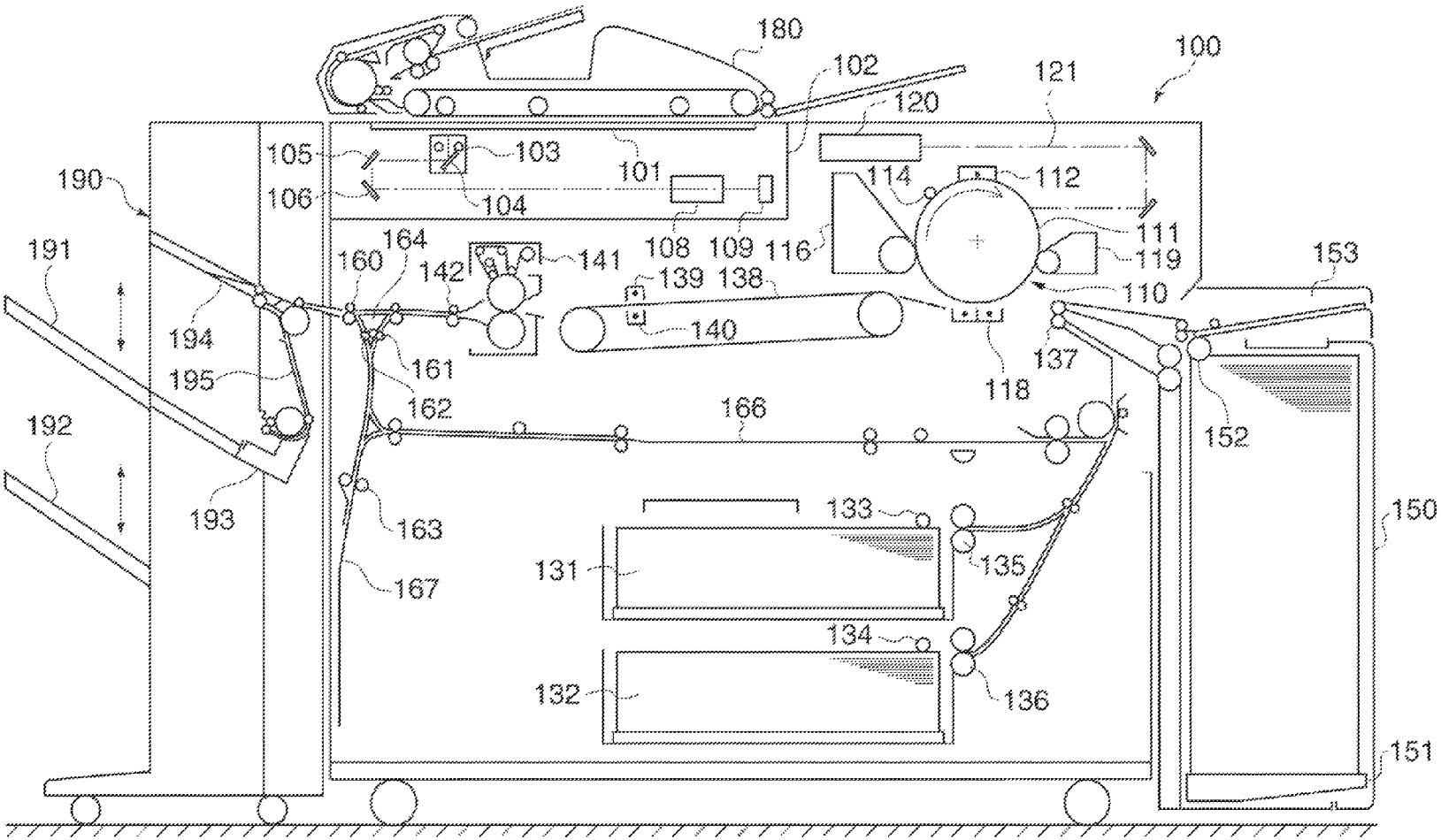
FIG. 1 is a section view showing an internal construction of an image forming system.

FIG. 1 shows in section an internal construction of an image forming system to which an image forming apparatus according to one embodiment of this invention is applied.

As shown in FIG. 1, the image forming system is mainly comprised of an image forming apparatus 100 and a sheet post-processing apparatus 190.

Referring to FIG. 1, an automatic document feeder 180 feeds a document onto a platen glass 101. A scanner 102 that has a document illumination lamp 103 and a scan mirror 104 scans the document fed onto the platen glass 101. Reflection light from the document is introduced into a CCD (charge coupled device) sensor 109 via the scan mirror 104, reflection mirrors 105, 106, and a lens 108, and converted into an electrical signal by the CCD sensor 109. Predetermined image processing is performed on the electrical signal, whereby an image signal is generated. An exposure controller 120 comprised of a laser, a polygon scanner, etc., scans a photosensitive drum 111 with laser light 121 modulated based on the image signal.

An image forming unit 110 is constituted by the photosensitive drum 111 together with a primary charging device 112, a developing device 119, a transfer charging device 118, a cleaning device 116, and a pre-exposure lamp 114, which are disposed near the photosensitive drum 111.

The photosensitive drum 111 is rotated by a motor (not shown) in a direction indicated by an arrow in FIG. 1, and is charged by the primary charging device 112 to a desired electrical potential. Then, the laser light 121 is irradiated from the exposure controller 120, whereby an electrostatic latent image is formed on the photosensitive drum 111. The electrostatic latent image is developed into a toner image by the developing device 119.

Upper and lower sheet feed cassettes 131, 132 store sheets (recording sheets or tabbed sheets). Sheets stored in the upper sheet feed cassette 131 are each fed by a pickup roller 133 and conveyed by a sheet feed roller 135 to a registration roller 137. Sheets stored in the lower sheet feed cassette 132 are each fed by a pickup roller 134 and conveyed by a sheet feed roller 136 to the registration roller 137. In other words, the pickup rollers 133, 134 and the sheet feed rollers 135, 136 function as a first supply unit for supplying tabbed sheets and a second supply unit for supplying recording sheets.

Each sheet conveyed to the registration roller 137 is conveyed to a transfer belt 138, and a toner image on the photosensitive drum 111 is transferred to the sheet by the transfer charging device 118.

Residual toner on the photosensitive drum 111 is cleaned by the cleaning device 116, and residual electric charge is erased by the pre-exposure lamp 114.

The sheet transferred with the toner image is separated from the transfer belt 138. The toner image on the sheet is re-charged by pre-fixing charging devices 139, 140 and pressurized and heated by a fixing device 141, whereby the toner image is fixed to the sheet. Then, the sheet is discharged by a sheet discharge roller 142 to the outside of the image forming apparatus 100.

A deck 150 provided in the image forming apparatus 100 is configured to be capable of storing e.g., up to 4000 sheets. The deck 150 has a lifter 151 that moves up according to the amount of sheets such that the top sheet is always in contact with a sheet feed roller 152. A multi-manual sheet feeder/tray 153 is configured to be capable of storing e.g. up to 100 sheets.

A sheet discharge flapper 164 is provided to make a changeover between a path toward an inversion path 167 and a path for sheet discharge. When the changeover to the path for double-sided recording is made by the sheet discharge flapper 164, the sheet fed from the sheet discharge roller 142 is turned upside down by the inversion path 167, is introduced to a lower conveyance path 166, and is conveyed from the lower conveyance path 166 to the registration roller 137. On the other hand, when the changeover to the path for sheet discharge is made by the sheet discharge flapper 164, the sheet is discharged by a discharge roller 160 disposed near the sheet discharge flapper 164 to a discharge port of the image forming apparatus 100.

To discharge the sheet fixed with the toner image to the discharge port, the changeover toward the inversion path 167 is made by the sheet discharge flapper 164. After the trailing end of the sheet passes through a first feed roller 161, the sheet is conveyed by the inversion roller 163 toward the second feed roller 162. Then, the sheet turned upside down is discharged by the discharge roller 160 to the discharge port.

The sheet post-processing apparatus 190 is provided to align and staple sheets discharged from the image forming apparatus 100. In a case that a post-processing operation such as sorting or stapling has not been set through an operation unit 172 (see FIG. 2) of the image forming apparatus 100, sheets are discharged one by one from the discharge port to a sheet discharge tray 191 after passing through a conveyance path 194. On the other hand, in a case that the post-processing operation has been set through the operation unit 172, sheets discharged from the discharge port and passing through a conveyance path 195 are stacked and aligned on a processing tray 193. After completion of sheet stacking on the processing tray 193, the sheets are stapled and the resultant sheet bundle is discharged to the sheet discharge tray 191 or 192. It should be noted that a plurality of sheet bundles can be stacked on each of the sheet discharge trays 191, 192.

One of the sheet discharge trays 191, 192 is moved by a motor (not shown) to a position where it is in alignment with the processing tray 193. In a case that the post-processing operation has been set, the sheet discharge tray 192 is normally moved to the position where it is in alignment with the processing tray 193, and sheet bundles are discharged to the sheet discharge tray 192. However, if the sheet discharge tray 192 is in a state full of sheet bundles, the sheet discharge tray 191 is moved to the position where it is in alignment of the processing tray 193 and sheet bundles are discharged to the tray 191.

Figure 2:
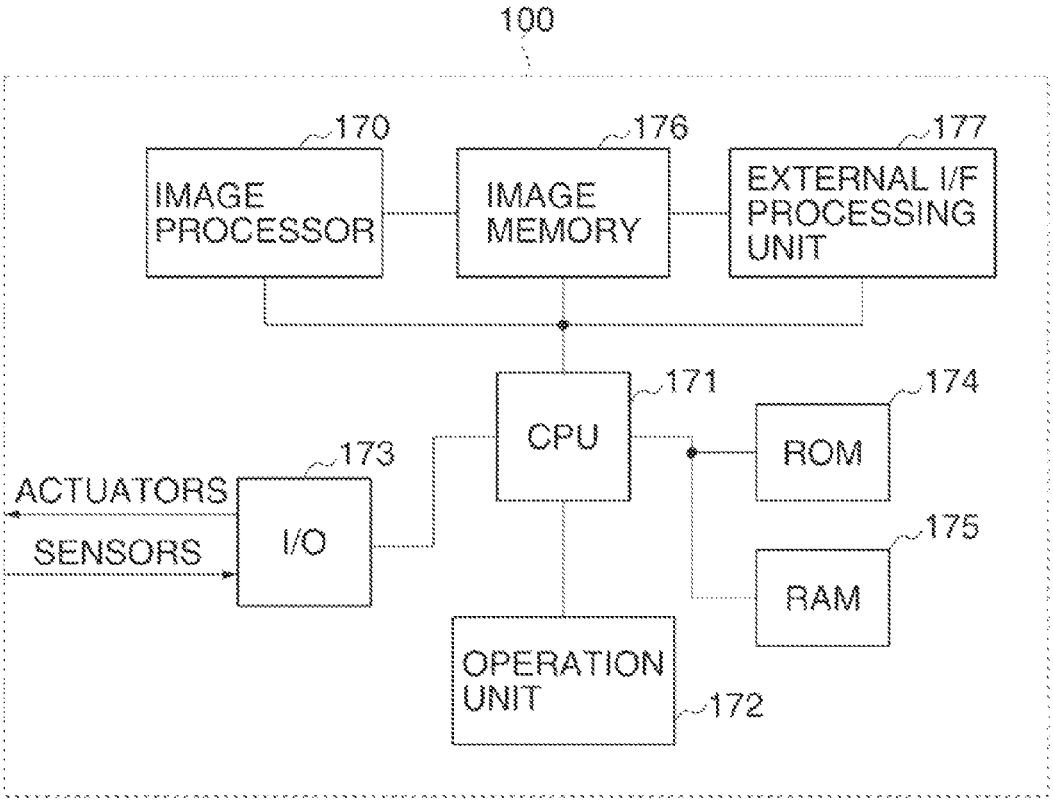
FIG. 2 is a block diagram showing a control structure of an image forming apparatus.

FIG. 2 shows in block diagram a control structure of the image forming apparatus 100.

As shown in FIG. 2, the image forming apparatus 100 has a CPU 171 to which an image processor 170, an operation unit 172, an input/output (I/O) port 173, a ROM 174, a RAM 175, an image memory 176, and an external I/F processing unit 177 are connected.

The CPU 171 executes control programs stored in the ROM 174 to thereby control the entirety of the apparatus 100. The RAM 175 is used as a work area that temporarily stores results of computation by the CPU 171, etc.

The input/output port 173 is connected with actuators (not shown) such as motors and clutches for driving various parts of the image forming apparatus 100, and is also connected with sensors (not shown) for detecting sheet conveyance positions, and the like. The CPU 171 controls input and output via the input/output port 173.

The operation unit 172 instructs the CPU 171 to change an image formation operation mode, display contents, or the like according to key input by a user. The operation unit 172 displays a state of the image forming apparatus 100 notified from the CPU 171, and also displays an operation mode set by key input. The image processor 170 processes an electrical signal supplied from the CCD sensor 109 (see FIG. 1). The image memory 176 stores image data supplied from the image processor 170. The external I/F processing unit 177 processes image data supplied from the CPU 171, as binary image data.

Figure 3:
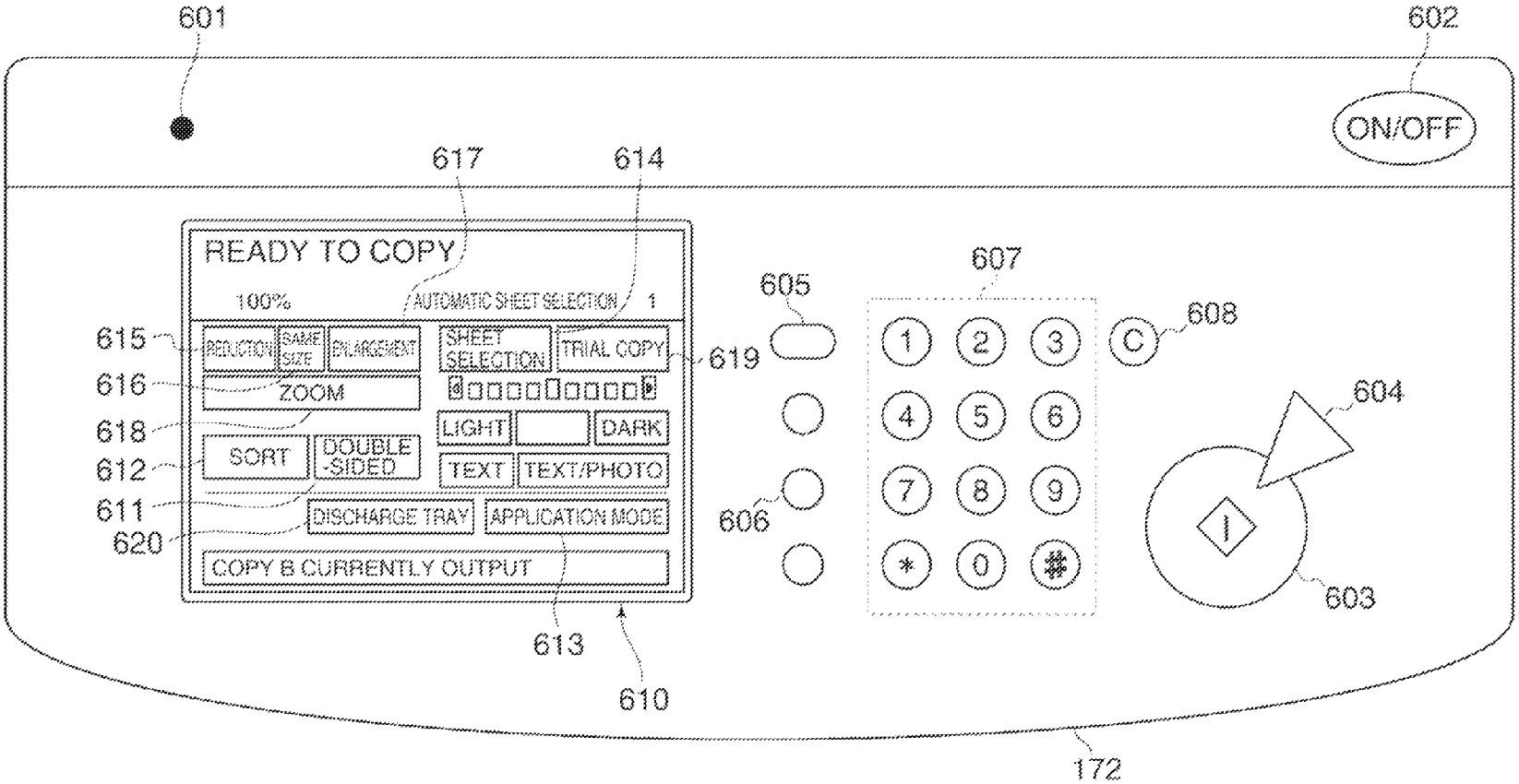
FIG. 3 is a view showing an outer appearance of an operation unit of the image forming apparatus.

FIG. 3 shows an outer appearance of the operation unit 172.

In FIG. 3, a power switch 602 is operated to turn on/off power supply to the image forming apparatus 100. When the power supply is turned on/off by the power switch 602, a power lamp 601 is turned on/off.

Ten keys 607 are used to input numerical values to set the number of sheets to be subjected to image formation and to set mode setting, and also used to input a telephone number on a fax setting screen. A clear key 608 is used to clear settings input through the ten keys 607, and a reset key 605 is used to restore the set number of sheets to be subjected to image formation, set operation mode, selected sheet feed stage, or the like to the default.

A start key 603 is used to start an image formation operation. Red and green LEDs (both not shown) are provided at a center of the start key 603. The red LED is turned on when the image formation operation cannot be started, whereas the green LED is turned on when the image formation operation can be started. A stop key 604 is used to stop the image formation operation.

When a setting key 606 is pressed, a setting screen (not shown) is displayed to enable the user to change settings of the image forming apparatus 100. For example, the user can change a set time up to when a setting is automatically cleared, and can change settings of general functions common to print and copy.

A display panel 610 is comprised of e.g. a liquid crystal display with touch panel, and display contents are changed according to the set mode.

When a selection key 614 is pressed, a setting screen (not shown) for setting any of the sheet feed cassettes 131, 132, the deck 150, and the manual sheet tray 153 as a sheet feeding source is displayed on the display panel 610.

Keys 615 to 618 are magnification setting keys for setting magnification in copying (reduction, same size, enlargement, and zoom). When an application mode setting key 613 is pressed, a setting screen for setting an application function mode such as multiple action mode, reduction layout mode, and cover sheet/slip sheet mode is displayed on the display panel 610. In an example of FIG. 11, application function mode setting keys are displayed. When any of the setting keys is pressed on the setting screen, a corresponding setting screen (not shown) for setting application mode is displayed on the display panel 610.

When a double-sided operation setting key 611 is pressed, a setting screen (not shown) is displayed. On the setting screen, it is possible, for example, to selectively set a "single-sided to double-sided" mode where a double-sided output is generated from two single-sided documents, a "double-sided to double-sided" mode where a double-sided output is generated from a double-sided document, or a "double-sided to single-sided" mode where two single-sided outputs are generated from a double-sided document.

When a soft key 612 is pressed, a setting screen (not shown) is displayed on which an operation mode of the sheet post-processing apparatus 190 and a sorting mode to sort output sheets by using the image memory 176 can be set.

A proof print mode key 619 is operated to set a proof print mode where if the sorting mode has been set and if a plurality of sheet bundles are output, a printing operation is temporarily stopped at completion of output of each sheet bundle, thereby enabling the user to confirm the finished sheet bundle. The user can select continuing the printing operation if the finished bundle is OK, and can select terminating the printing operation if the finished bundle is NG.

When the user setting key 606 of the operation unit 172 is pressed, a setting screen (not shown) is displayed for setting an initial value of discharge tray for each job type. When a discharge tray key 620 is pressed on the display panel 610, a setting screen (third setting unit) is displayed for setting a discharge tray for each job.

At a lower part of the display panel 610, an operation state of other function mode (described later) is displayed in single line.

As described above, various keys are displayed on the display panel 610. It should be noted that there is a case where no setting screen can be displayed in response to the press of a key. In that case, the key is displayed in half-tone dot meshing to indicate that the key cannot be operated.

It should be noted that in the example of FIG. 3, setting contents of copy operation and a current operation state are displayed with words on the display panel 610, however, they can be displayed with symbols.

Next, a description will be given of a recording sheet conveyance path with reference to FIGS. 4 to 6.

Figure 4:
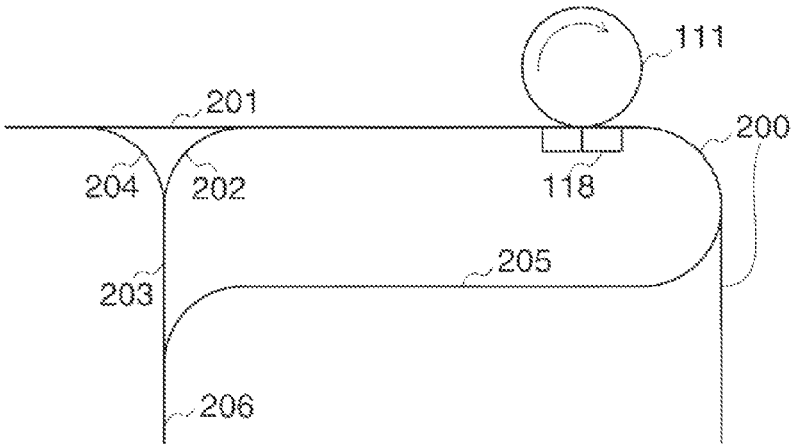
FIG. 4 is a view schematically showing a recording sheet conveyance path in the image forming apparatus.

FIG. 4 schematically shows a recording sheet conveyance path in the image forming apparatus 100.

As shown in FIG. 4, the recording sheet conveyance path is mainly formed by seven conveyance paths 200 to 206.

The conveyance path 200 is a path along which a recording sheet fed from any of the manual sheet tray 153 and the sheet feed cassettes 131, 132 (which are shown in FIG. 1) is conveyed to between the photosensitive drum 111 and the transfer charging device 118. The conveyance path 201 is a path along which the recording sheet to which a toner image on the photosensitive drum 111 has been transferred is conveyed via the fixing device 141 shown in FIG. 1 to the outside (i.e., to the sheet discharge tray 191 or 192 or to the processing tray 193 shown in FIG. 1).

The conveyance path 202 is a path along which the recording sheet to which the toner image on the photosensitive drum 111 has been transferred is introduced into the conveyance path 203 via the fixing device 141. The conveyance path 204 is a path along which the recording sheet introduced into the conveyance path 203 is discharged to the outside. The conveyance path 205 is a path along which the recording sheet introduced into the conveyance path 203 is refed to between the photosensitive drum 111 and the transfer charging device 118. The conveyance path 206 is a path where the recording sheet conveyed along the conveyance path 203 is switched back and guided to the conveyance path 205.

Figure 5A:
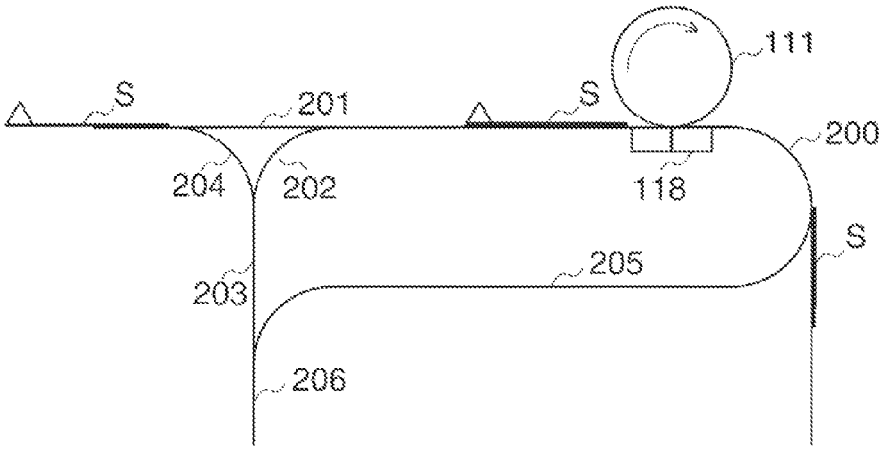
FIGS. 5A and 5B are views schematically showing recording sheet conveyance paths for single-sided image formation in a face-up sheet discharge mode and in a face-down sheet discharge mode, respectively.
Figure 5B:
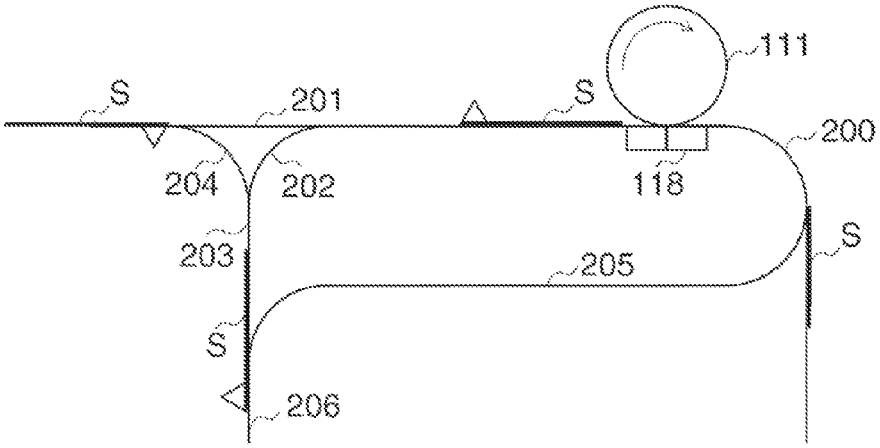
Figure 6A:
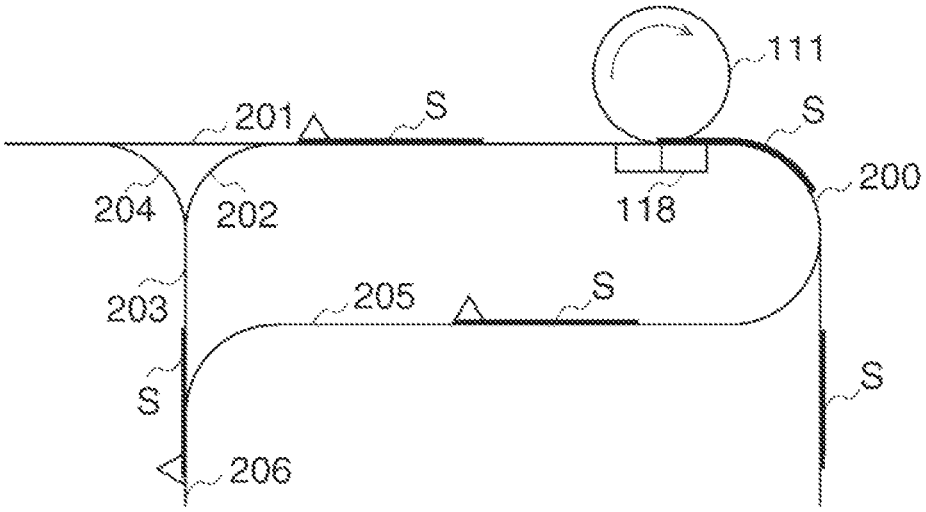
FIG. 6A is a view schematically showing a recording sheet conveyance path for double-sided image formation.

FIGS. 5A and 5B schematically show recording sheet conveyance paths for single-sided image formation in a face-up sheet discharge mode and in a face-down sheet discharge mode, respectively. FIG. 6A schematically shows a recording sheet conveyance path for double-sided image formation.

In the face-up sheet discharge mode (non-inversion discharge mode), a recording sheet formed with an image is discharged to the outside, with its front surface upward. In the face-down sheet discharge mode (inversion discharge mode), a recording sheet formed with an image is discharged to the outside, with its back surface upward. In the following description, it is assumed that recording sheets are fed from the upper sheet feed cassette 131.

In the single-sided image formation in face-up sheet discharge mode, a recording sheet S fed from the upper sheet feed cassette 131 is first conveyed via the conveyance path 200 to between the photosensitive drum 111 and the transfer charging device 118, as shown in FIG. 5A. Next, a toner image on the photosensitive drum 111 is transferred to the front surface of the recording sheet S. Subsequently, the recording sheet S is conveyed to the fixing device 141 where the toner image is fixed to the recording sheet S, and the recording sheet S fixed with the toner image is discharged to the outside via the conveyance path 201.

On the other hand, in the single-sided image formation in face-down sheet discharge mode, a recording sheet S fixed with a toner image is temporarily introduced into the conveyance path 203 via the conveyance path 202, and then discharged to the outside via the conveyance path 204, as shown in FIG. 5B, whereby the recording sheet S is face-down discharged to the outside.

In FIGS. 5A and 5B, triangle marks attached to recording sheets S each denote an image formation surface.

In the double-sided image formation, as shown in FIG. 6A, a recording sheet S fed from the upper sheet feed cassette 131 is first conveyed via the conveyance path 200 to between the photosensitive drum 111 and the transfer charging device 118. Next, a toner image on the photosensitive drum 111 is transferred to a first surface (front surface) of the recording sheet S, and the recording sheet S is conveyed to the fixing device 141 where the toner image is fixed to the recording sheet S. The recording sheet S fixed with the toner image is temporarily introduced into the conveyance path 206 via the conveyance paths 202, 203, and is switched back and introduced into the sheet refeeding conveyance path 205. These conveyance paths where image formation is performed on the first surface of a recording sheet S fed from the conveyance path 200 and the recording sheet S is introduced again into the conveyance path 200 for image formation on its second surface (back surface) will be referred to as the double-sided circulation path.

To perform double-sided image formation on a plurality of recording sheets, first an image is formed on and fixed to the first surface of the top recording sheet fed from the upper sheet feed cassette 131. The top recording sheet fixed with the image is switched back and introduced into the sheet refeeding conveyance path 205, and is temporarily stopped at a stop position 210 for waiting for arrival of timing of image formation on the second surface. At a timing where image formation on the second surface of the top recording sheet has been prepared, the top recording sheet is refed and conveyed via the conveyance path 200 to between the photosensitive drum 111 and the transfer charging device 118. Then, image formation on the first surface of a recording sheet next fed from the sheet feed cassette and image formation on the second surface of the recording sheet refed from the conveyance path 205 are alternately performed.

In the following, the number of recording sheets present on the double-sided circulation path starting from the conveyance path 200 and returning thereto via the conveyance paths 202, 203, 206, and 205 will be referred to as the number of circulating sheets, and image formation on both surfaces of respective ones of recording sheets on the double-sided circulation path will be referred to as the circulating image formation.

Figure 6B:
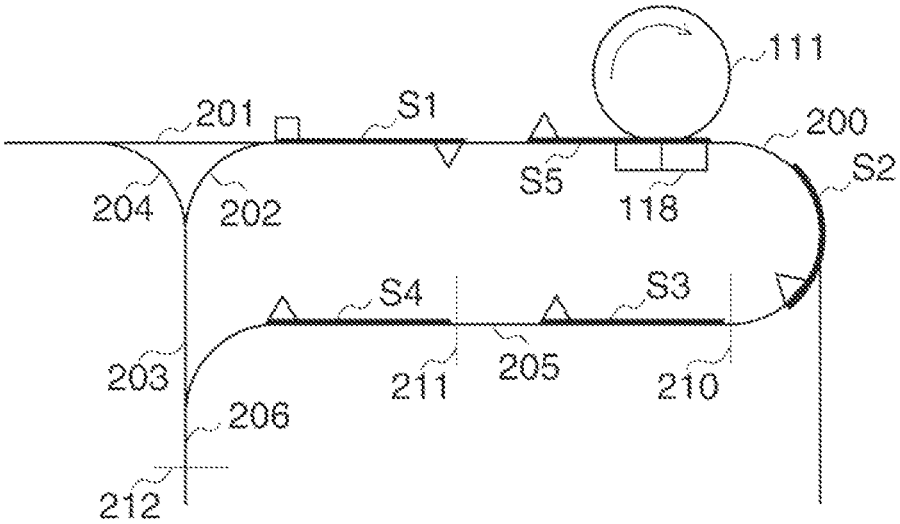
FIG. 6B is a view showing a relationship between the number of circulating recording sheets and recording sheet stop positions in the double-sided image formation.

FIG. 6B shows a relationship between the number of circulating sheets and stop positions in an example where the number of circulating sheets is five.

In FIG. 6B, there is shown a state where recording sheets S1 to S5 are present on the double-sided circulation path. Positions where recording sheets can be stopped are indicated by reference numerals 210 to 212. Each recording sheet stops at any of the stop positions 210 to 212, but there is no case where recording sheets simultaneously stop at the three stop positions 210 to 212. In other words, any of the three stop positions becomes an empty state. A recording sheet stops the most downstream stop position among one or more stop positions that are in an empty state. In the example of FIG. 6B, the stop position 212 is in an empty state. If recording sheets stop at all the stop positions, there is no position where a subsequent recording sheet can stop, and recording sheets will collide with each other. To obviate this, any of the stop positions is made to be an empty state. The maximum number of circulating sheets is represented by $2N-1$, where N represents the number of stop positions. The stop positions and the number of stop positions vary according to the size of recording sheets.

In the double-sided image formation, after image formation on the second surface of the top recording sheet, image formation on first surfaces of recording sheets and image formation on second surfaces of recording sheets are alternately performed. After completion of image formation on the first surface of the last recording sheet among recording sheets to be subjected to the double-sided image formation, image formation is only performed on the second surfaces of recording sheets already formed with images on their first surfaces. With such circulating image formation, the productivity is lowered because a recording sheet interval becomes greater in a time period until recording sheets whose number is equal to the number of circulating sheets are disposed on the double-sided circulation path and in a time period from when image formation on the first surface of the last recording sheet is completed to when image formation on the second surface of the last recording sheet is finished.

It should be noted that in FIG. 6B, each of triangle marks attached to recording sheets S indicates the first surface (front surface) on which image formation is first performed, and a square mark indicates the second surface (back surface) on which image formation is performed after the sheet refeeding.

Next, with reference to FIGS. 7 and 8, a description will be given of the order of sheet feeding in the circulating image formation for cases where the number of circulating sheets is three and five, respectively.

Figure 7A:
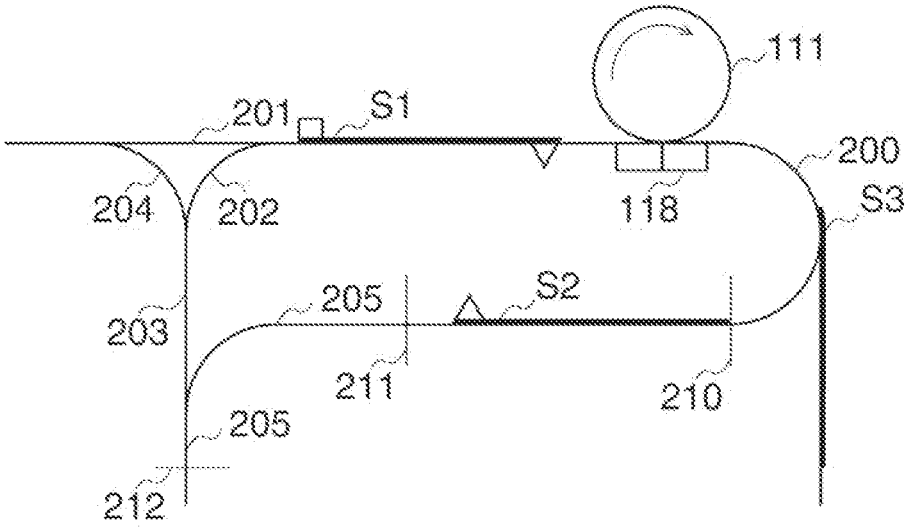
FIG. 7A is a view schematically showing a conveyance state of recording sheets on a conveyance path in the case of double-sided image formation where the number of circulating sheets is three.
Figure 7B:
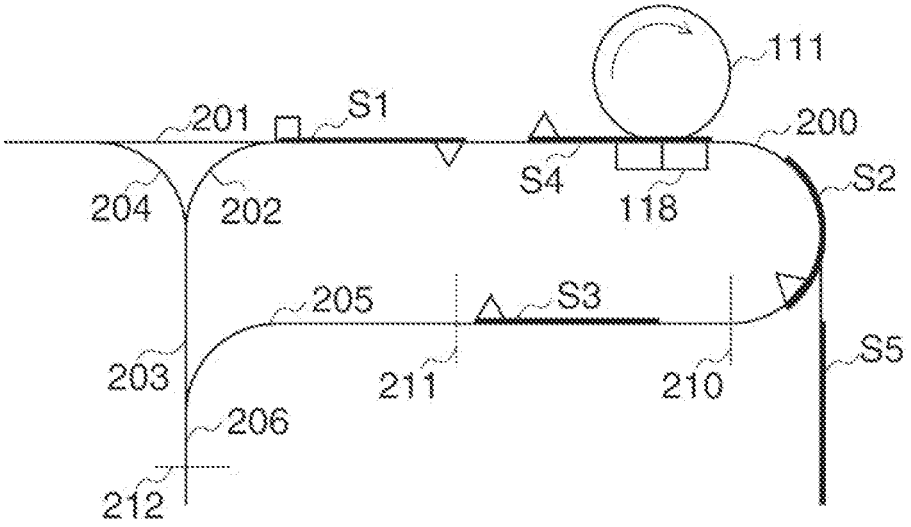
FIG. 7B is a view schematically showing a conveyance state of recording sheets on the conveyance path in the case of double-sided image formation where the number of circulating sheets is five.

FIGS. 7A and 7B schematically respectively show conveyance states of recording sheets on the conveyance path in the case of circulating image formation. FIG. 7A shows a case where the number of circulating sheets is three, and FIG. 7B shows a case where the number of circulating sheets is five. It should be noted that FIGS. 7A and 7B are illustrated without strictly taking into account the size of recording sheets and the sheet interval. The number of circulating sheets and the sheet interval vary according to the size of recording sheets, and are not limited to those in the illustrated example (Ditto in FIGS. 8A and 8B).

Figure 8A:
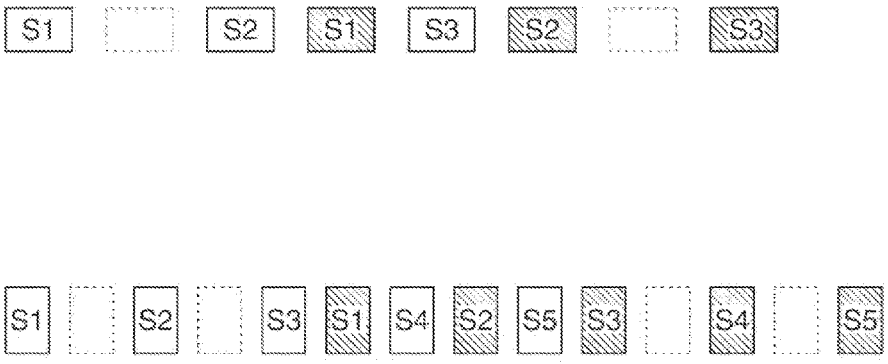
FIG. 8A is view showing the order of recording sheet feeding/refeeding in the case of double-sided image formation where the number of circulating sheets is three.

FIGS. 8A and 8B show the order of recording sheet feeding/refeeding in the case of circulating image formation. FIG. 8A shows a case where the number of circulating sheets is three, and FIG. 8B shows a case where the number of circulating sheets is five. In FIGS. 8A and 8B, rectangles illustrated in solid line each represent a recording sheet formed with an image on its first surfaces, rectangles illustrated in broken line each represent a sheet interval (blank sheet feeding) required to ensure the number of circulating sheets for the circulating image formation, and hatched rectangles each represent a recording sheet formed with an image on its second surface after the sheet refeeding.

In a case that the number of circulating sheets is three, first and second recording sheets S1, S2 are sequentially fed with a predetermined sheet interval therebetween as shown in FIG. 8A, and image formation is performed on respective first surfaces of the recording sheets S1, S2. Upon completion of image formation on the first surface of the second recording sheet S2, the first recording sheet S1 formed with an image on its first surface is refed and inserted into between the second and third recording sheets S2, S3.

When the first recording sheet S1 is refed, image formation is performed on the second surface of the recording sheet S1, and the third recording sheet S3 is subsequently supplied from the upper sheet feed cassette 131. At that time, as shown in FIG. 7A, the first recording sheet S1 is being conveyed along the conveyance path 201, the second recording sheet S2 is being conveyed along the sheet refeeding conveyance path 205 or stops at one of the stop positions, and the third recording sheet S3 is being supplied from the upper sheet feed cassette 131 to the conveyance path 200.

Referring to FIG. 8A again, the second recording sheet S2 is refed after the third recording sheet S3 is supplied. Then, image formation is performed on the second surface of the recording sheet S2, and the recording sheet S3 is refed with a predetermined sheet interval. Subsequently, an image is formed on the second surface of the recording sheet S3.

In a case that the number of circulating sheets is five, as shown in FIG. 8B, first to third recording sheets S1 to S3 are sequentially supplied with a predetermined sheet interval, and image formation is performed on the respective first surfaces of the recording sheets S1 to S3. Upon completion of the image formation on the first surface of the third recording sheet S3, the first recording sheet S1 formed with an image on its first surface is refed and inserted into between the third and fourth recording sheets S3, S4.

When the recording sheet S1 is refed, image formation is performed on the second surface of the recording sheet S1. Subsequently, image formation is performed on the first surface of the recording sheet S4. At this time, as shown in FIG. 7B, the recording sheet S1 formed with images on its both surfaces is being conveyed to the outside via the conveyance path 201, and the recording sheet S4 is in a state where a toner image is being transferred to the first surface of the sheet S4. The recording sheet S2 is being conveyed toward the photosensitive drum 111 along the conveyance path 200, and the recording sheet S3 is being conveyed along the sheet refeeding conveyance path 205.

Referring to FIG. 8B again, a fifth recording sheet S5 is supplied after the second recording sheet S2 is refed. After completion of image formation on the second surface of the recording sheet S2, image formation is performed on the first surface of the recording sheet S5, and the recording sheet S3 is refed. Next, the recording sheet S4 is refed with a predetermined sheet interval, and then the recording sheet S5 is refed with the predetermined sheet interval.

As described above, recording sheets whose number is equal to the number of circulating sheets are fed or refed from when one recording sheet is started to be fed for image formation on its first surface to when the one recording sheet is refed after having rounded the double-sided circulation path. It should be noted that the sheet interval shown by each of the broken rectangles in FIGS. 8A and 8B is regarded as the feeding or refeeding of one recording sheet.

Figure 9:
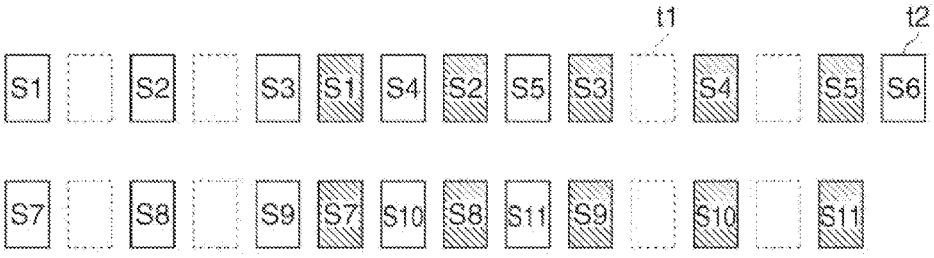
FIG. 9 is view showing the order of sheet feeding in the case of circulating image formation where double-sided image formation and single-sided image formation are mixedly performed.

FIG. 9 shows the order of sheet feeding in the case of circulating image formation where double-sided image formation and single-sided image formation are mixedly performed. In the illustrated example, a case is shown in which single-sided image formation is performed on one recording sheet subsequently to double-sided image formation on five recording sheets, and then double-sided image formation is performed on other five recording sheets.

The double-sided image formation for the first five recording sheets is performed in the same manner as with the case of FIG. 8B. More specifically, image formation is performed on the second surface of the recording sheet S1 subsequently to image formation on first surfaces of the first to third recording sheets S1 to S3, and then image formation on the first surface of the fourth recording sheet S4 is performed. Subsequently, image formation on the second surfaces of recording sheets and image formation on the first surfaces of recording sheets are alternately performed.

To perform double-sided image formation on a sixth recording sheet S6, no trouble is caused even if the recording sheet S6 is fed at a timing (denoted by symbol t1 in FIG. 9)

between the refeeding of the recording sheet S3 and the refeeding of the recording sheet S4.

In this example, however, since single-sided image formation is designated for the sixth recording sheet S6, the recording sheet S6 is not introduced into the sheet refeeding conveyance path 205 for double-sided image formation, but discharged to the outside. Accordingly, if the recording sheet S6 is fed at timing t1, recording sheets are discharged in a wrong order.

To maintain a correct order of sheet discharge, it is necessary to feed the sixth recording sheet S6 at timing t2 after the refeeding of the fifth recording sheet S5 for image formation on its second surface. Subsequently, single-sided image formation is performed on the recording sheet S6, and double-sided image formation is performed on the remaining five recording sheets S7 to S11. In that case, circulation of double-sided image formation is broken by the single-sided image formation on the recording sheet S6, and therefore, new circulation of five circulating sheets is started from the seventh recording sheet S7 for double-sided image formation.

In a printing job where double-sided image formation and single-sided image formation are mixed, it is necessary to perform blank sheet feeding to adjust a sheet feed timing at start of circulating image formation after single-sided image formation, as described above, in order to feed/refeed recording sheets in the order shown in FIG. 9. As a result, the productivity of image formation on recording sheets is lowered.

Figure 10A:
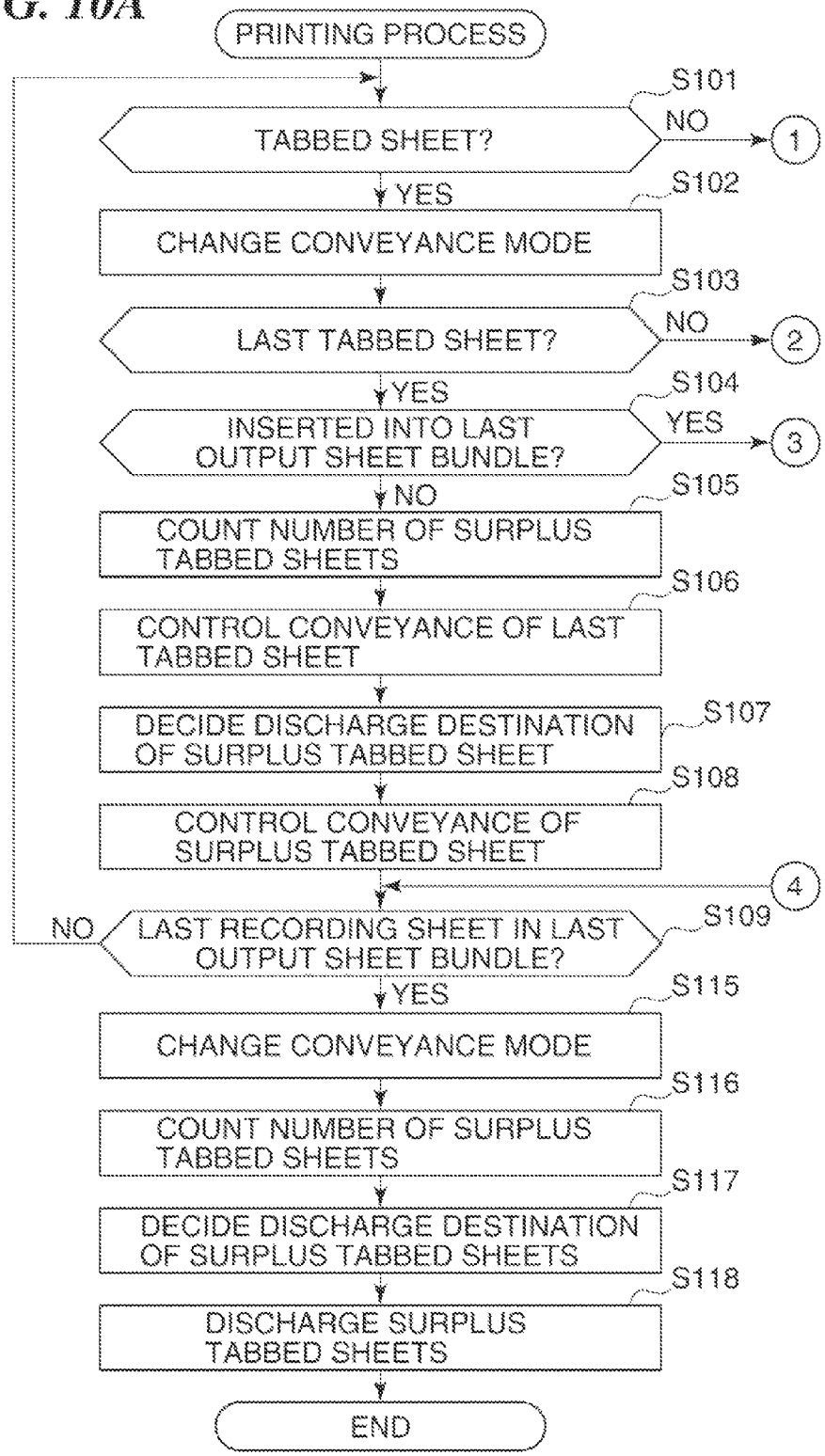
FIGS. 10A and 10B are a flowchart showing procedures of a printing process executed by a CPU of the image forming apparatus.
Figure 10B:
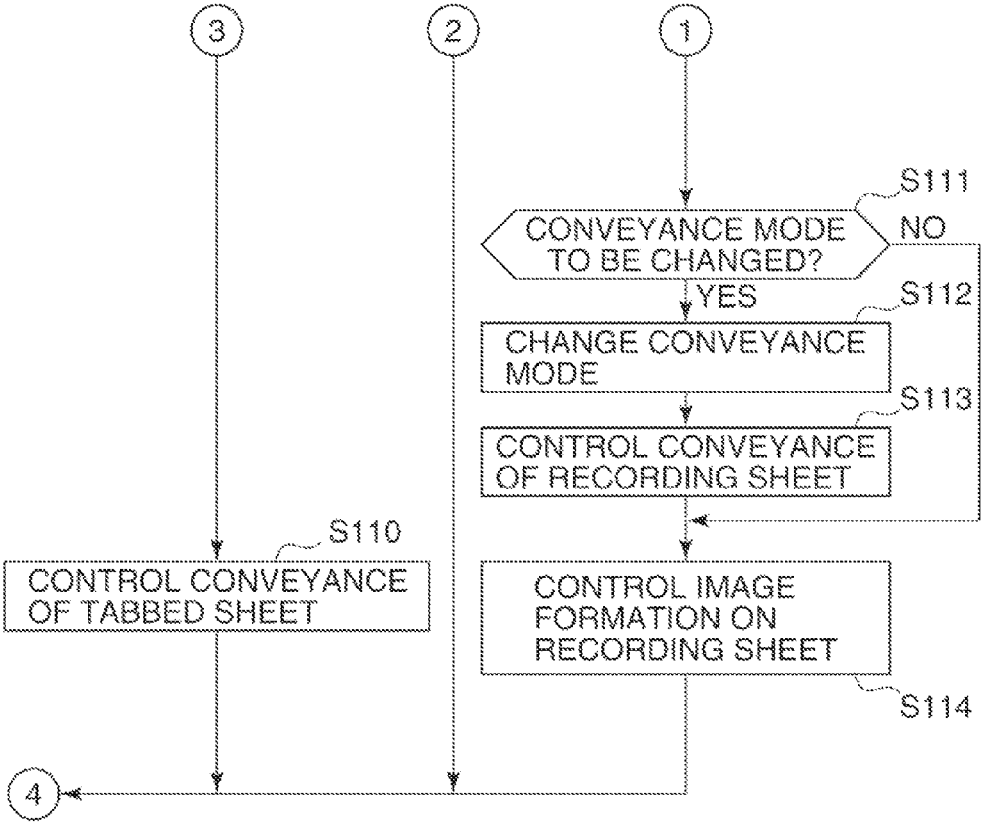

FIGS. 10A and 10B show in flowchart the procedures of a printing process executed by the CPU 171 of the image forming apparatus 100. More specifically, there is shown a double-sided printing process, which is performed when a tabbed sheet mode is selected.

Prior to the printing process being started, the user performs various settings of the image forming apparatus 100 as described below.

Figure 11:
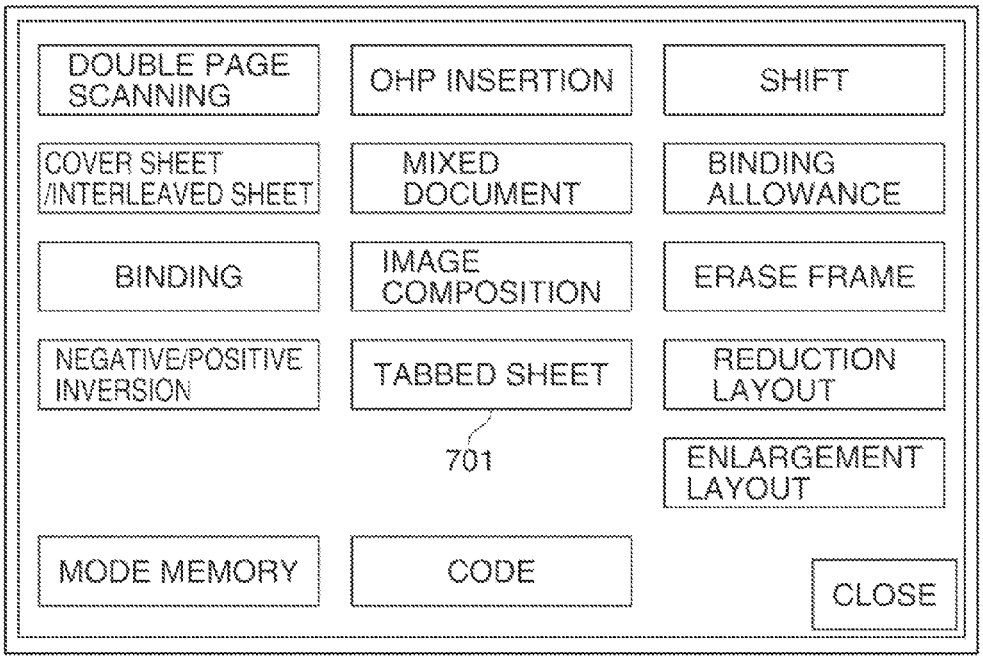
FIG. 11 is a view showing an example of a setting screen displayed on a display panel.
Figure 12:
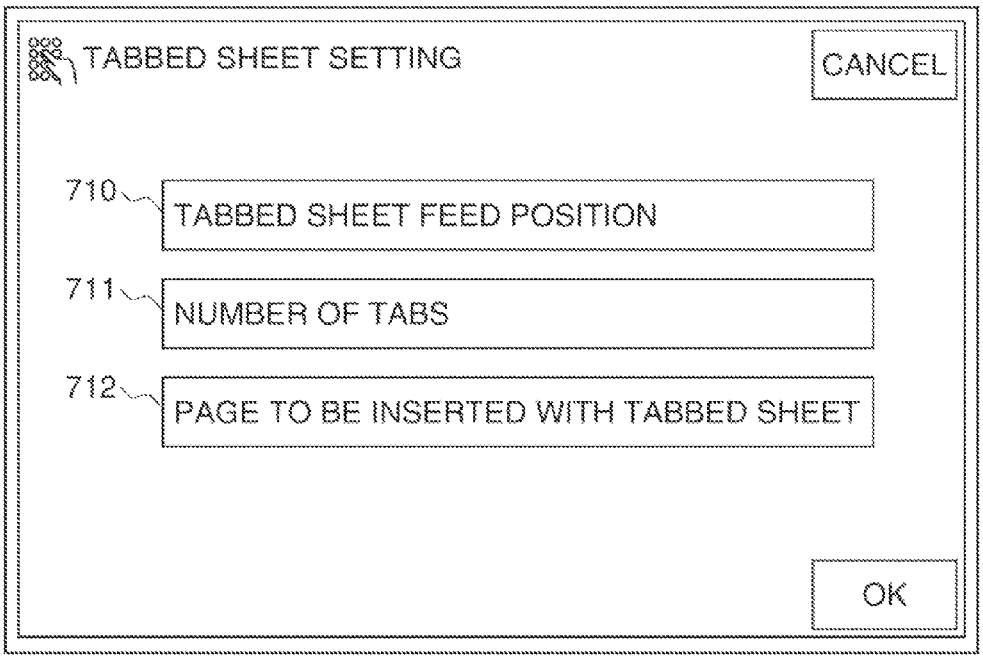
FIG. 12 is a view showing an example of a tabbed sheet setting screen displayed on the display panel.

FIG. 11 shows an example of a setting screen displayed on the display panel 610 when the application mode key 613 shown in FIG. 3 is pressed. FIG. 12 shows an example of a tabbed sheet setting screen displayed in response to a "tabbed sheet" key 701 being pressed on the setting screen shown in FIG. 11.

When a "tabbed sheet feed position" key 710, a "number of tabs" key 711, or a "page to be inserted with tabbed sheet" key 712 is pressed on the setting screen of FIG. 12, a setting screen is displayed for setting a tabbed sheet feed stage, a number of tabs, or a tabbed sheet position.

Figure 13:
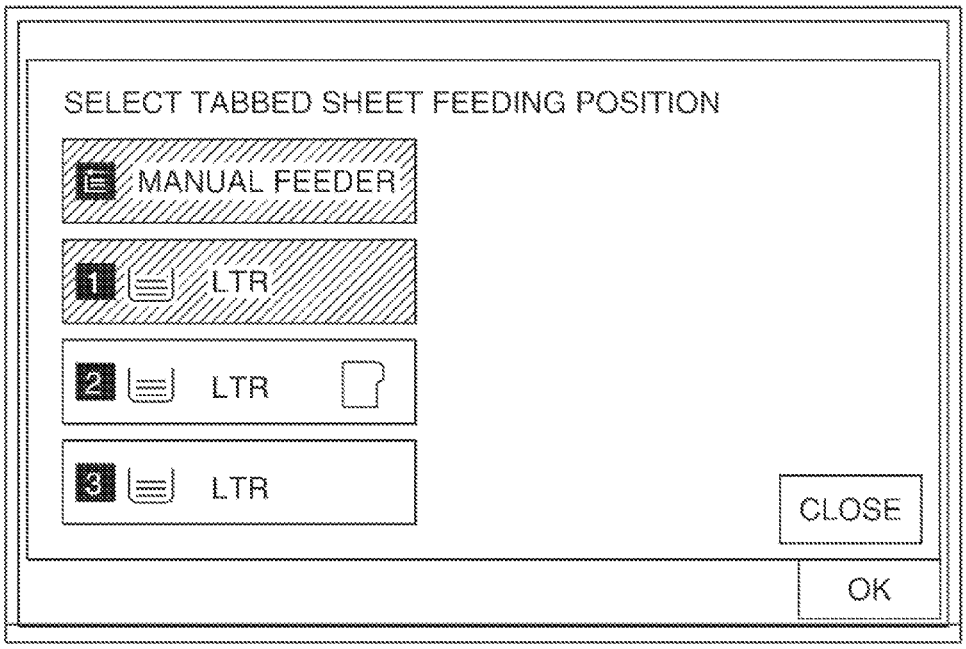
FIG. 13 is a view showing an example of a tabbed sheet feed stage setting screen displayed on the display panel.

FIG. 13 shows an example of the tabbed sheet feed stage setting screen. In the illustrated example of the setting screen, sheet feed stages in which tabbed sheets can be set are limited. More specifically, tabbed sheets can be set only in the second and third sheet feed stages, and cannot be set in other sheet feed stages. In the setting screen, buttons corresponding to sheet feed stages in which tabbed sheets cannot be set are hatched. It should be noted that such buttons can be displayed in half-tone dot meshing instead of being displayed in hatching.

Figure 14:
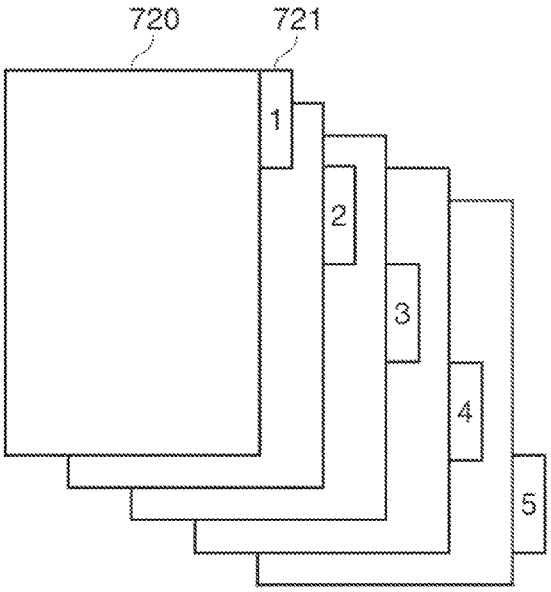
FIG. 14 is a view showing an example of a tabbed sheet bundle.

FIG. 14 shows an example of a tabbed sheet bundle. As shown in FIG. 14, the tabbed sheet bundle is comprised of five tabbed sheets 720 to which index tabs 721 are added at different positions.

Figure 15:
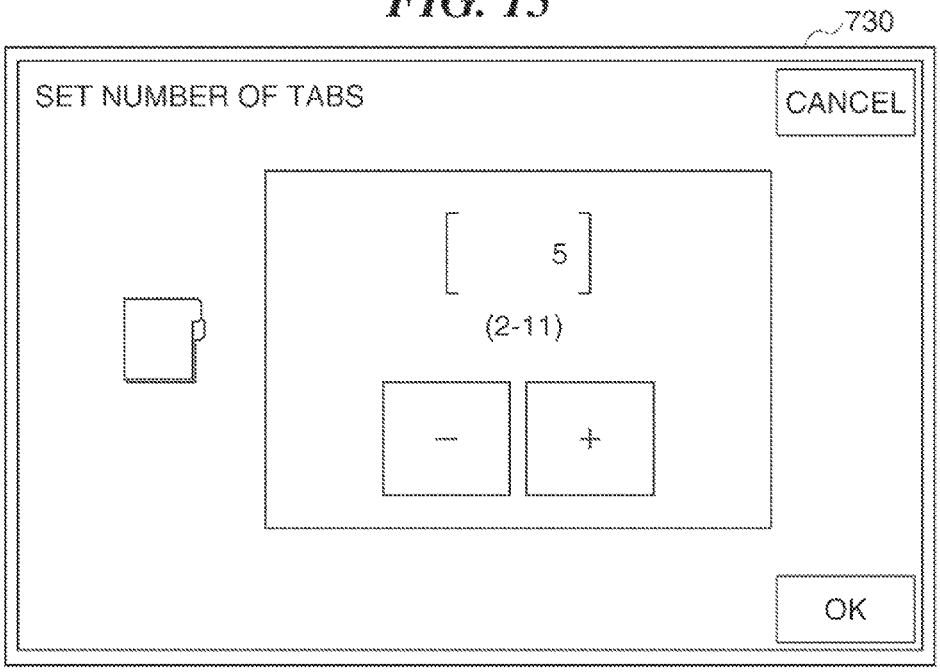
FIG. 15 is a view showing an example of a "number of tabs" setting screen displayed on the display panel.

FIG. 15 shows an example of the "number of tabs" setting screen. On the "number of tabs" setting screen 730, a type of tabbed sheets (the number of tabs) constituting a tabbed sheet bundle can be set. In the illustrated example, the number of tabs can be set to any of "2" to "11" and an initial value thereof is "5."

Figure 16:
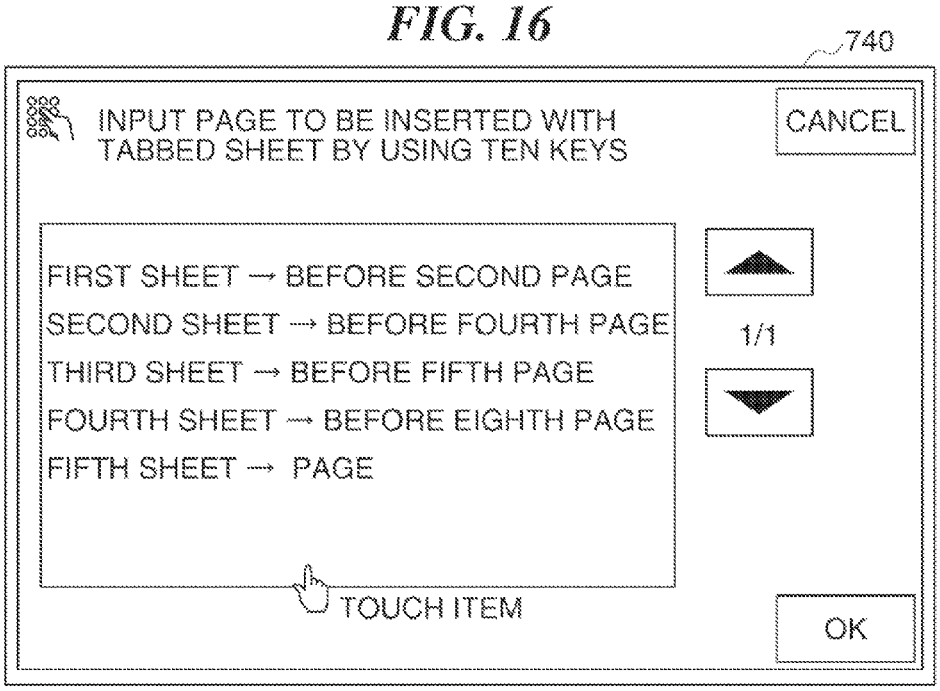
FIG. 16 is a view showing an example of a tabbed sheet position setting screen displayed on the display panel.

FIG. 16 shows an example of the tabbed sheet position setting screen. In a case that the number of insertion positions set on the tabbed sheet position setting screen 740 (second setting unit) is not divisible by the number of tabs set on the "number of tabs" setting screen 730 (first setting unit) shown in FIG. 15, one or more surplus tabbed sheets are occurred in each of a plurality of tabbed sheet bundles.

The above-described various settings are made, and a plurality of tabbed sheet bundles each comprised of tabbed sheets whose number is equal to the set number of tabs are loaded to the set tabbed sheet feed stages. In that state, when the user presses the start key 603 of the operation unit 172 shown in FIG. 3, the printing process of FIGS. 10A and 10B is started.

In the printing process of FIGS. 10A and 10B, the CPU 171 first determines whether or not a sheet to be fed is a tabbed sheet (step S101). If determined that the sheet to be fed is a tabbed sheet, the CPU 171 changes the sheet conveyance mode to the single-sided image formation mode, after waiting for completion of image formation on the second surface of a recording sheet performed immediately before the feeding of the tabbed sheet (step S102).

Next, the CPU 171 determines whether or not the tabbed sheet to be fed is the last tabbed sheet to be used for formation of the output sheet bundle by comparing the number of insertion positions set on the tabbed sheet position setting screen 740 of FIG. 16 with the number of fed tabbed sheets (i.e., the number of sheets counted from the top tabbed sheet of the tabbed sheet bundle including the tabbed sheet to be fed) (step S103).

If determined in step S103 that the tabbed sheet to be fed is the last tabbed sheet to be used for formation of the output sheet bundle, the CPU 171 determines whether or not the tabbed sheet to be fed will be inserted into the last output sheet bundle among a plurality of output sheet bundles to be subjected to the present printing process based on e.g. the number of sets of bundles that has been set through the ten keys 607 shown in FIG. 3 (step S104).

If determined in step S104 that the tabbed sheet to be fed will not be inserted into the last output sheet bundle, the CPU 171 counts the number of surplus tabbed sheets (step S105), and controls conveyance of the last tabbed sheet of the output sheet bundle (step S106). Next, the CPU 171 (decision unit) decides a discharge destination to which surplus tabbed sheets are to be discharged based on e.g. a discharge destination of surplus tabbed sheets set on a screen, which is displayed in response to the discharge tray key 620 shown in FIG. 3 being pressed (step S107). Then, the CPU 171 controls conveyance of surplus tabbed sheets to the discharge destination decided in step S107 (step S108), and proceeds to step S109.

If determined in step S104 that the tabbed sheet to be fed will be inserted into the last output sheet bundle, the CPU 171 controls conveyance of the tabbed sheet (step S110), and proceeds to step S109.

If determined in step S101 that the sheet to be fed is not a tabbed sheet, i.e., if the sheet to be fed is a recording sheet, the CPU 171 determines whether or not it is necessary to change the conveyance mode (step S111). If the preceding sheet is a tabbed sheet, the conveyance mode changed to the single-sided image formation mode in step S102 in the preceding cycle of the present process must be changed to the double-sided image formation mode.

If determined in step S111 that it is necessary to change the conveyance mode, the CPU 171 changes the conveyance mode to the double-sided image formation mode (circulating image formation) (step S112), controls conveyance of the recording sheet (step S113), and controls image formation on the recording sheet (step S114). Subsequently, the process proceeds to step S109.

In step S109, the CPU 171 determines whether or not the recording sheet, which is the object of determination, is the last recording sheet in the printing process. In other words, the CPU 171 determines whether or not the recording sheet is the last recording sheet in the last output sheet bundle among the plurality of output sheet bundles to be subjected to the printing process. If determined in step S109 that the recording sheet is not the last recording sheet, the process returns to step S101. On the other hand, if determined that the recording sheet is the last recording sheet, the process proceeds to step S115.

Figure 17A:
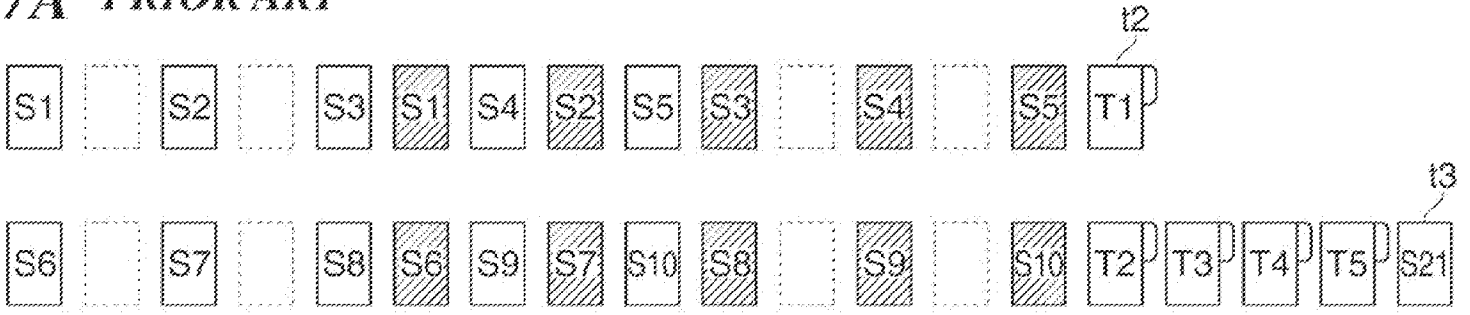
FIG. 17A PRIOR ART
FIG. 17A is a view showing the order of sheet feeding/refeeding in a tabbed sheet mode in a conventional image forming apparatus.
Figure 17B:
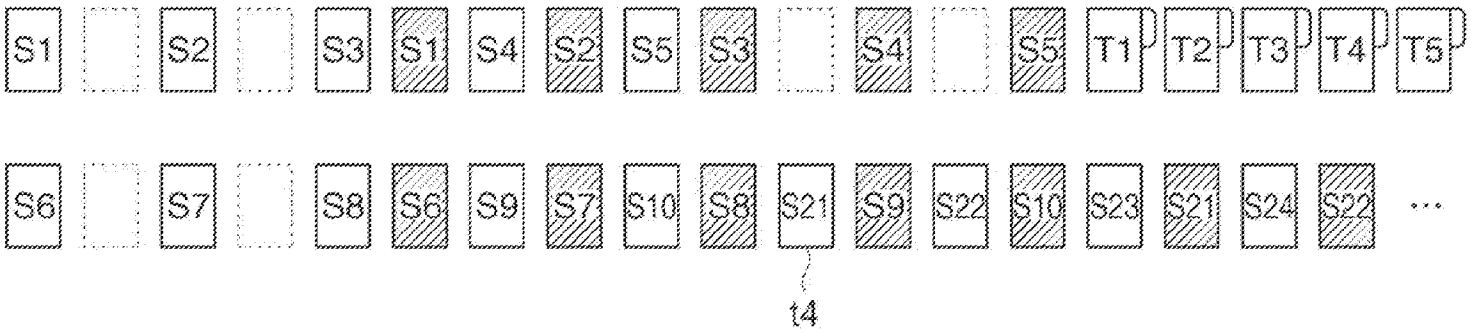
FIG. 17B is a view showing the order of sheet feeding/refeeding in the tabbed sheet mode in the image forming apparatus shown in FIG. 1.

FIG. 17A shows the order of sheet feeding/refeeding in a tabbed sheet mode in a conventional image forming apparatus, and FIG. 17B shows the order of sheet feeding/refeeding in the tabbed sheet mode in the image forming apparatus 100 of this embodiment.

FIGS. 17A and 17B each show the order of sheet feeding/refeeding in a case that one tabbed sheet is inserted subsequently to double-sided image formation (double-sided image forming operation) on five (predetermined number of) recording sheets, and then double-sided image formation is performed on other five recording sheets. The order of sheet feeding/refeeding in these examples is the same as that shown in FIG. 9, except that one tabbed sheet is inserted instead of performing single-sided image formation on one recording sheet.

In these examples, tabbed sheet bundles are used each comprised of five tabbed sheets as shown in FIG. 14, and a tabbed sheet feed stage in which a plurality of tabbed sheet bundles are set is set on the setting screen of FIG. 13. Further, the type of tabbed sheets (the number of tabs) is set to e.g. "5" on the setting screen 730 of FIG. 15, and the tabbed sheet position is set to e.g. "first tabbed sheet is inserted before sixth page" on the setting screen 740 of FIG. 16. In that case, four surplus tabbed sheets are occurred in each bundle.

A tabbed sheet T1 is inserted at timing t2 where image formation on the second surface of the fifth recording sheet S5 is completed. It should be noted that it is possible, where required, to perform image formation only on one surface of the tabbed sheet T1.

In the sheet feeding/refeeding control of FIG. 17A performed in a conventional image forming apparatus, image formation is performed on both surfaces of five recording sheets S1 to S5. Next, the conveyance mode is changed to a single-sided image formation mode, and the tabbed sheet T1 is inserted. Subsequently, the conveyance mode is changed to a double-sided image formation mode, and double-sided image formation is performed on five recording sheets S6 to S10, whereby one output sheet bundle is completed.

In the case of creating each output sheet bundle as described above, four surplus tabbed sheets T2 to T5 are occurred since each of tabbed sheet bundles set in the image forming apparatus is comprised of five tabbed sheets. Thus, after waiting for completion of image formation on the last recording sheet of one output sheet bundle, i.e., on the second surface of the tenth recording sheet S10, the four surplus tabbed sheets T2 to T5 are discharged in the single-sided image formation mode to a discharge destination. Then, after waiting for completion of discharge of the last surplus tabbed sheet T5, a second output sheet bundle is started to be produced at timing t3.

As described above, circulating image formation must be temporarily stopped to perform processing for discharging surplus tabbed sheets between image formation on the last recording sheet of one output sheet bundle and image formation on the first recording sheet of the next output sheet bundle. Accordingly, the productivity of image formation is lowered.

On the other hand, in the sheet feeding/refeeding control of FIG. 17B performed by the image forming apparatus 100 of this embodiment, the surplus tabbed sheets T2 to T5 are discharged to a discharge destination subsequently to the feeding of the tabbed sheet T1 by the processing performed in steps S105 to S108 of the printing process shown in FIGS. 10A and 10B. It is therefore possible to feed a first recording sheet S21 of the next output sheet bundle and to perform image formation on the sheet S21 at timing t4 shown in FIG. 17B, without terminating circulating image formation between output sheet bundles, whereby the productivity of image formation can be improved.

Referring to FIGS. 10A and 10B again, in step S115, the CPU 171 changes the conveyance mode to the single-sided image formation mode to discharge the last surplus tabbed sheet in the last tabbed sheet bundle, and then performs processing in steps S116 to S118 which is similar to the processing in steps S105, S107, and S108. More specifically, the CPU 171 counts the number of surplus tabbed sheets (step S116), decides a discharge destination to which surplus tabbed sheets are discharged (step S117), and discharges the surplus tabbed sheets (step S118), whereupon the present printing process is completed.

Since no recording sheet is fed or refed subsequently to the last output sheet bundle, surplus tabbed sheets in this embodiment are not discharged after completion of image formation on the last recording sheet used to form the last output sheet bundle, but discharged subsequently to conveyance of the last tabbed sheet in the last tabbed sheet bundle as previously described, whereby the productivity of image formation on the last bundle can be improved further.

As described above, according to this embodiment, it is possible to eliminate a time for waiting for discharge of surplus tabbed sheets (i.e., a time for waiting for refeeding of the last recording sheet of each output sheet bundle for image formation on the second surface thereof) that can occur in the conventional image forming apparatus in a case that surplus tabbed sheets are occurred in the double-sided image formation on recording sheets in the tabbed sheet mode. As a result, the productivity can be improved.

While the present invention has been described with reference to an exemplary embodiment, it is to be understood that the invention is not limited to the disclosed exemplary embodiment. The scope of the following claims is to be accorded the broadest interpretation so as to encompass all such modifications and equivalent structures and functions.

This application claims the benefit of Japanese Patent Application No. 2012-159602, filed Jul. 18, 2012, which is hereby incorporated by reference herein in its entirety.

What is claimed is:

1. An image forming apparatus comprising:

a first supply unit configured to supply at least one tabbed sheet one by one from each of a plurality of tabbed sheet bundles each comprised of tabbed sheets that are different in tab position from one another;

a second supply unit configured to supply recording sheets;

a conveyance unit configured to convey the at least one tabbed sheet supplied by said first supply unit and the recording sheets supplied by said second supply unit and to discharge them to outside;

an image forming unit configured to form images on both surfaces of each of the recording sheets conveyed by said conveyance unit; and a control unit configured to, in a case where at least one surplus tabbed sheet not inserted into corresponding each of a plurality of output sheet bundles remains in each of the plurality of tabbed sheet bundles when outputting the plurality of output sheet bundles each having the at least one tabbed sheet inserted into a recording sheet bundle comprised of recording sheets each formed with images on both sides by a double-sided image forming operation of said image forming unit:

control said first supply unit and said conveyance unit so that the at least one surplus tabbed sheet is conveyed directly after conveyance of the tabbed sheet to be lastly inserted into each of a respective one of the plurality of output sheet bundles other than the last output sheet bundle; and control said first supply unit and said conveyance unit so that the at least one surplus tabbed sheet is conveyed subsequently to conveyance of the last recording sheet used to form the last output sheet bundle.

2. The image forming apparatus according to claim 1, further including:

a double-sided circulation path along which each of recording sheets supplied by said second supply unit is conveyed so that image formation is performed on the both sides of the recording sheet, wherein in the double-sided image forming operation, after continuously performing image formation on a first side of a predetermined number of recording sheets supplied from said second supply unit, said image forming unit alternately performs image formation on a second side of recording sheets conveyed along said double-sided circulation path and image formation on the first side of recording sheets supplied from said second supply unit, and continuously performs image formation on the second side of the predetermined number of recording sheets conveyed along said double-sided circulation path until the tabbed sheet is supplied from said first supply unit.

3. The image forming apparatus according to claim 2, wherein said image forming unit performs the double-sided image forming operation after the tabbed sheet is supplied and until a tabbed sheet to be inserted next is supplied.

4. The image forming apparatus according to claim 1, further including:

a first setting unit configured to set a number of tabbed sheets included in each of the tabbed sheet bundles;

a second setting unit configured to set at least one page in each of the plurality of output sheet bundles where the at least one tabbed sheet is to be inserted; and a determination unit configured to determine whether or not the at least one surplus tabbed sheet remains based on a number of tabbed sheets for each of which the page where the tabbed sheet is to be inserted has been set by said second setting unit and the number of tabbed sheets included in each tabbed sheet bundle set by said first setting unit, wherein in a case where said determination unit determines that the at least one surplus tabbed sheet remains, said control unit controls said conveyance unit so that the at least one surplus tabbed sheet is discharged subsequently to conveyance of the tabbed sheet to be lastly inserted, among the at least one tabbed sheets for each of which the page where the tabbed sheet is to be inserted has been set by said second setting unit.

5. The image forming apparatus according to claim 1, further including:

a plurality of stacking units, wherein said control unit controls said conveyance unit so that recording sheets in the output sheet bundle and the at least one surplus tabbed sheet are respectively discharged to different stacking units.

6. The image forming apparatus according to claim 5, further including:

a decision unit configured to decide a stacking unit to which the at least one surplus tabbed sheet is to be discharged, wherein said control unit controls said conveyance unit so that the at least one surplus tabbed sheet is discharged to the stacking unit decided by said decision unit.

7. The image forming apparatus according to claim 6, further including:

a designation unit configured to manually designate a stacking unit, wherein said decision unit decides the stacking unit designated by said designation unit, as the stacking unit to which the at least one surplus tabbed sheet is to be discharged.

8. A control method for an image forming apparatus having a first supply unit configured to supply at least one tabbed sheet, a second supply unit configured to supply recording sheets, a conveyance unit configured to convey the tabbed sheet supplied by the first supply unit and the recording sheets supplied by the second supply unit and to discharge them to outside, and an image forming unit configured to perform a double-sided image forming operation to form images on both surfaces of each of the recording sheets conveyed by the conveyance unit, the control method comprising:

a supplying step of causing the first supply unit to supply at least one tabbed sheet one by one from each of a plurality of tabbed sheet bundles each comprised of tabbed sheets that are different in tab position from one another; and controlling steps of, in a case where at least one surplus tabbed sheet not inserted into corresponding each of a plurality of output sheet bundles remains in each of the plurality of tabbed sheet bundles when outputting the plurality of output sheet bundles each having the at least one tabbed sheet inserted into a recording sheet bundle comprised of recording sheets each formed with images on both sides by the double-sided image forming operation of the image forming unit:

controlling the first supply unit and the conveyance unit so that the at least one surplus tabbed sheet is conveyed directly after conveyance of the tabbed sheet to be lastly inserted into each of a respective one of the plurality of output sheet bundles other than the last output sheet bundle; and controlling the first supply unit and the conveyance unit so that the at least one surplus tabbed sheet is conveyed subsequently to conveyance of the last recording sheet used to form the last output sheet bundle.

9. A non-transitory computer-readable storage medium storing a program executable by a computer to perform a control method for an image forming apparatus having a first supply unit configured to supply at least one tabbed sheet, a second supply unit configured to supply recording sheets, a conveyance unit configured to convey the tabbed sheet supplied by the first supply unit and the recording sheets supplied by the second supply unit and to discharge them to outside, and an image forming unit configured to perform a double-sided image forming operation to form images on both surfaces of each of the recording sheets conveyed by the conveyance unit, the control method comprising:

a supplying step of causing the first supply unit to supply at least one tabbed sheet one by one from each of a plurality of tabbed sheet bundles each comprised of tabbed sheets that are different in tab position from one another; and controlling steps of, in a case where at least one surplus tabbed sheet not inserted into corresponding each of a plurality of output sheet bundles remains in each of the plurality of tabbed sheet bundles when outputting the plurality of output sheet bundles each having the at least one tabbed sheet inserted into a recording sheet bundle comprised of recording sheets each formed with images on both sides by the double-sided image forming operation of the image forming unit:

controlling the first supply unit and the conveyance unit so that the at least one surplus tabbed sheet is conveyed directly after conveyance of the tabbed sheet to be lastly inserted into each of a respective one of the plurality of output sheet bundles other than the last output sheet bundle; and controlling the first supply unit and the conveyance unit so that the at least one surplus tabbed sheet is conveyed subsequently to conveyance of the last recording sheet used to form the last output sheet bundle.

* * * * *